US005588859A

United States Patent [19]

Maurice

[11] Patent Number: 5,588,859

[45] Date of Patent: Dec. 31, 1996

[54] HERMAPHRODITE CONTACT AND A CONNECTION DEFINED BY A PAIR OF SUCH CONTACTS

[75] Inventor: Denis Maurice, Rimogne, France

[73] Assignee: Alcatel Cable Interface, Vrigne Aux Bois, France

[21] Appl. No.: 306,595

[22] Filed: Sep. 15, 1994

[30] Foreign Application Priority Data

Sep. 20, 1993 [FR] France ..... 93 11162

[51] Int. Cl.[6] ..... H01R 4/24

[52] U.S. Cl. ..... 439/290; 439/395

[58] Field of Search ..... 439/398, 402, 439/403, 290, 291, 395

[56] References Cited

U.S. PATENT DOCUMENTS

| | | | |
|---|---|---|---|
| 3,703,700 | 11/1972 | Hasselbohm . | |
| 4,118,103 | 10/1978 | Leidy et al. | 439/398 |
| 4,317,608 | 3/1982 | Dechelette | 439/403 |
| 4,527,852 | 7/1985 | Dechelette | 439/398 |
| 4,895,531 | 1/1990 | Vignoli | 439/398 |

FOREIGN PATENT DOCUMENTS

| | | |
|---|---|---|
| 2600825A1 | 12/1987 | France . |
| 2696880 | 4/1994 | France . |
| 1490833 | 8/1971 | Germany . |

*Primary Examiner*—Gary F. Paumen
*Attorney, Agent, or Firm*—Sughrue, Mion, Zinn, Macpeak & Seas

[57] ABSTRACT

A hermaphrodite contact, flat and substantially rectangular in shape, including at least one resilient terminal arm and a "main" insulation displacement fork, wherein the main insulation displacement fork opens out towards the terminal end portion of the resilient arm.

7 Claims, 3 Drawing Sheets

HERMAPHRODITE CONTACT AND A CONNECTION DEFINED BY A PAIR OF SUCH CONTACTS

The present invention is concerned with a hermaphrodite contact, of the type comprising a resilient terminal arm for hermaphrodite coupling to another contact of the same type and an insulation displacement fork for connecting a conductor to the contact. It is also concerned with a connection defined by a pair of such contacts.

BACKGROUND OF THE INVENTION

Document FR-A-2696880 in the name of the present applicant describes a hermaphrodite contact of this type. That contact is flat. In particular, it is formed by two cut out blades, which are held against each other, being united along one of their edges. On the contact the blades define both the insulation displacement fork and two resilient terminal arms, the fork opening out in the edge where the two blades are joined, and being opposite to the resilient arms. Those two blades are formed from an initial blade-forming strip which is twice the length and folded in half, the edge along which the two blades are joined being the axis along which the initial strip is folded. The two resilient arms are parts of the first and second blades respectively. The width of each arm is substantially half that of each blade, and the arms extend generally on respective sides of the longitudinal axis of the contact. The planes of the two arms are offset merely by the thickness of one of the blades.

OBJECT AND SUMMARY OF THE INVENTION

The object of the present invention is to provide a hermaphrodite contact having modified access to its insulation displacement fork and therefore advantageously also allowing a branch connection to be formed on that same contact.

The invention provides a hermaphrodite contact, that is flat and substantially rectangular in shape, comprising at least one resilient terminal arm and a "main" insulation displacement fork, wherein the main insulation displacement fork has an access opening situated facing the terminal portions of the resilient arms and extends from said access opening towards a first end of said contact, opposite from the terminal portions of the arms.

Advantageously, this contact also has at least one of the following additional features:

- it comprises another "branch" insulation displacement fork, which is open on said first end of the contact;
- it is constituted by two blades placed against each other and united along the first end edge of the contact and is provided with two resilient terminal arms extending towards an opposite end edge, said resilient arms each being part of one of the blades and extending on respective sides of the longitudinal axis of the contact, the contact also including two deep U-shaped splits each formed in a respective one of the blades and extending towards said first end edge of the contact, and which are partly superposed over one another so as to define said main insulation displacement fork and said access opening.

The invention also provides a connection defined by coupling together first and second contacts, wherein the resilient arms of said first contact also partly overlap each other on either side of said longitudinal axis of the first contact, while the resilient arms of the second contact are set back from the longitudinal axis of the second contact, to leave between them a gap corresponding substantially to the overlapping portions of the resilient arms of the first contact.

BRIEF DESCRIPTION OF THE DRAWINGS

The features and advantages of the present invention appear from the following description of embodiments shown in the accompanying drawings, in which.

MORE DETAILED DESCRIPTION

The hermaphrodite contacts of the invention are flat and substantially rectangular in shape as generally indicated. They are constituted by two blades placed against each another and united along one of the short edges of each contact, this being produced by folding in half an initial blade-forming strip which is of twice the length.

Figure 1:
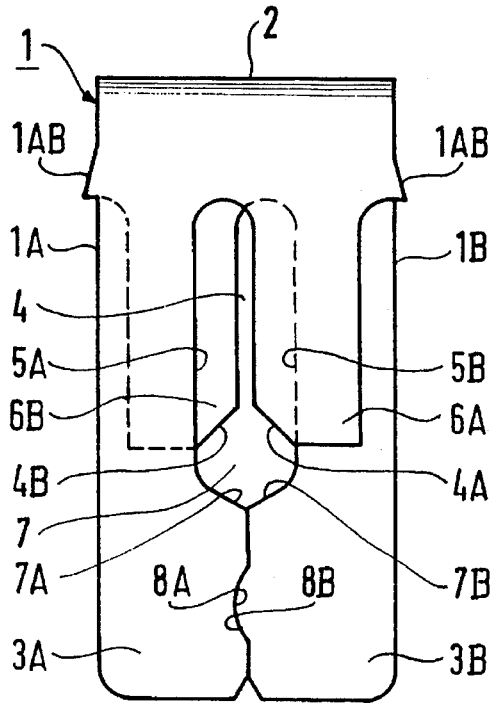
FIG. 1 is an elevation view of a contact of the invention.

With reference to FIG. 1, it can be seen that the contact 1 is formed by two blades 1A and 1B which are placed against each other and united along the short end edge 2 of the contact. The contact comprises two resilient terminal arms 3A and 3B, each of which is part of one of the blades and has a width substantially half that of the blade, the arms extending along respective sides of the longitudinal axis of the contact, at its end opposite the edge 2.

This contact also comprises an insulation displacement fork 4, having its opening facing the resilient arms 3A and 3B.

This fork extends substantially axially along the contact. It is defined by two deep U-shaped splits 5A and 5B, each of which is formed in one of the blades, the splits overlapping partially. One of the two sides of each split forms part of the corresponding resilient arm, while the other side of each slot forms a respective truncated branch 6A or 6B. Each split forms a curved transition region 7A or 7B where it runs into its terminal portion. These two splits are superposed along the longitudinal axis of the contact and therefore define the narrow insulation displacement fork, between the inside edges of the truncated branches 6A and 6B.

The contact also has two teeth given identical references 1AB and protruding from the outside edges both of the resilient arms and of the truncated branches. They are located substantially at the base of the insulation displacement fork.

An access opening 7 for the insulation displacement fork is defined on the contact by the opening of each of the slits 5A and 5B. The opening is delimited between terminal chamfers 4A and 4B on the inside edges of the two truncated branches, which together form a V-shaped entrance to the insulation displacement fork, and by the two curved transition regions 7A and 7B. This access opening allows ready insertion of an insulated conductor into the front of the fork, so that it can be pushed down to the bottom of that fork to make connection.

This contact 1 and another identical contact are coupled together to define a releasable connection, the resilient arms of one contact overlapping above and below the resilient arms of the other, each resilient arm also abutting the end of the opposite truncated branch. Two conductor wires connected to the two forks of the connection thereby defined are held captive in the connection.

Also shown in this FIG. 1 are a small boss 8B on the inside edge of arm 3B and a shallow indentation 8A on the inside edge of arm 3A, these promoting good coupling between the inside edges of the resilient arms of the two contacts.

Figure 2:
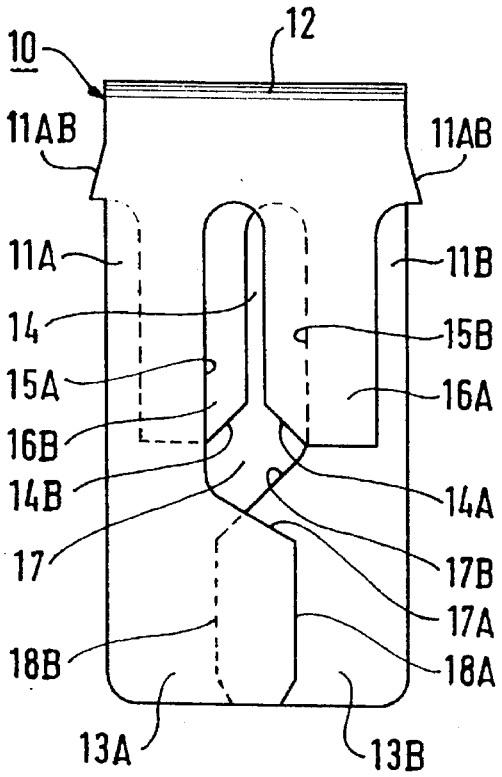
FIGS. 2 and 3 are elevations of a preferred embodiment of a first and a second contact of the invention, for forming a connection.
Figure 3:
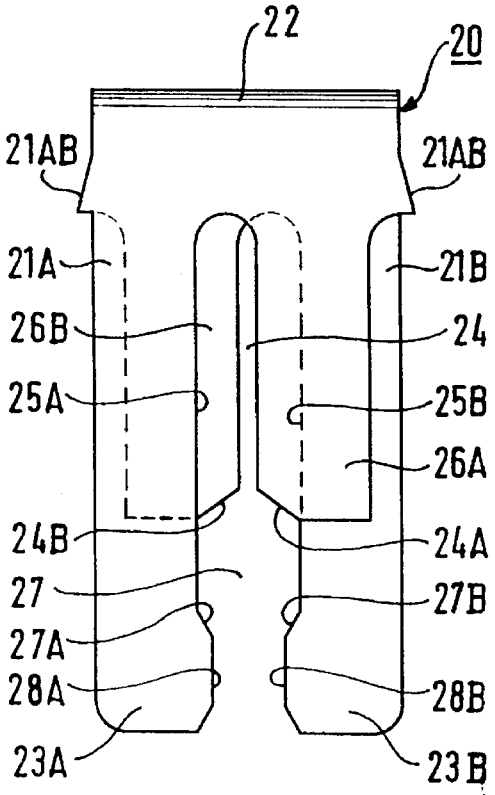
Figure 4:
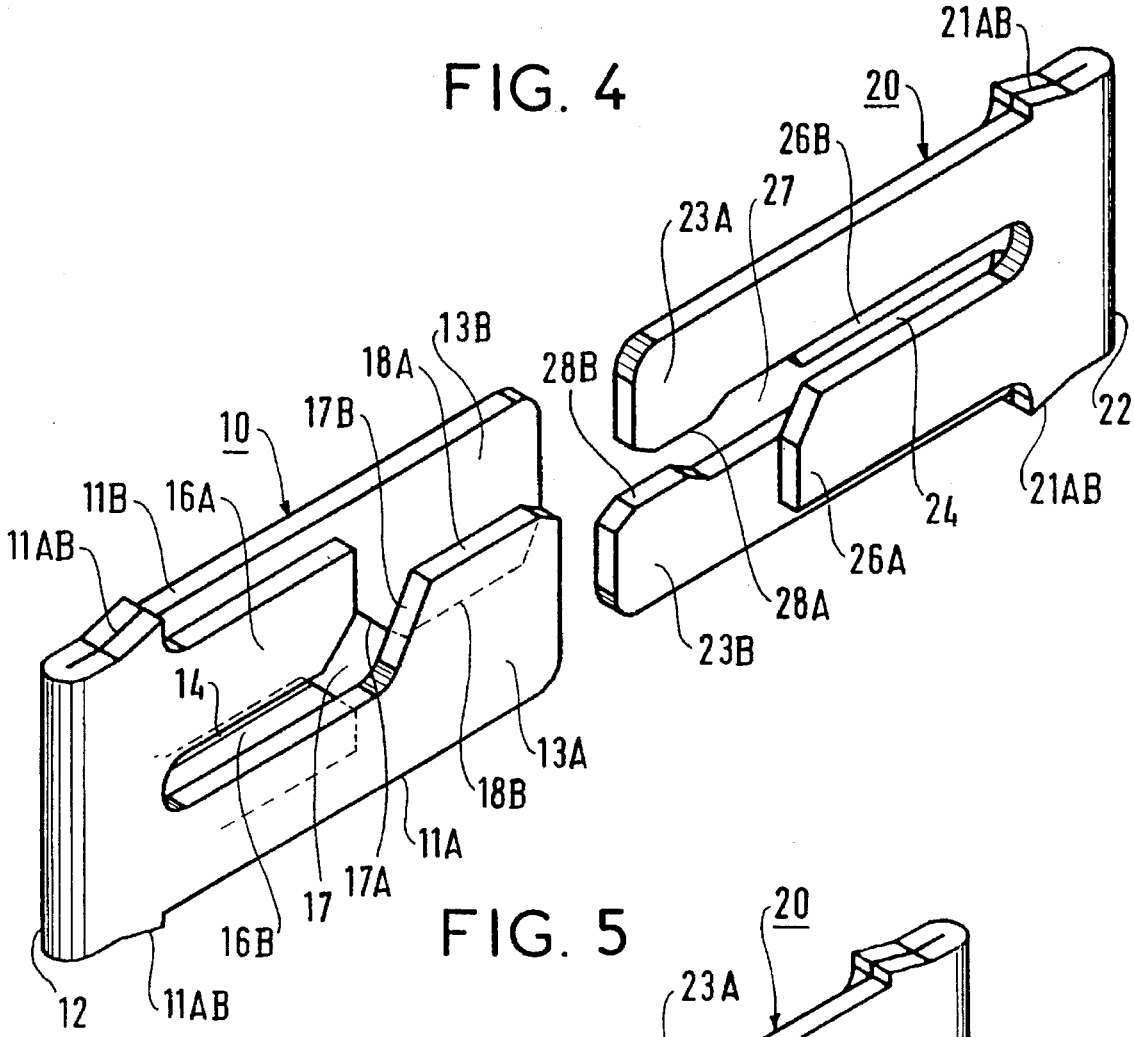
FIGS. 4 and 5 are two perspective views illustrating the connection defined by the contacts of FIGS. 2 and 3, and FIGS. 6 and 7 show an additional adaptation of the first and second contacts, to provide a branch connection on each contact.
Figure 5:
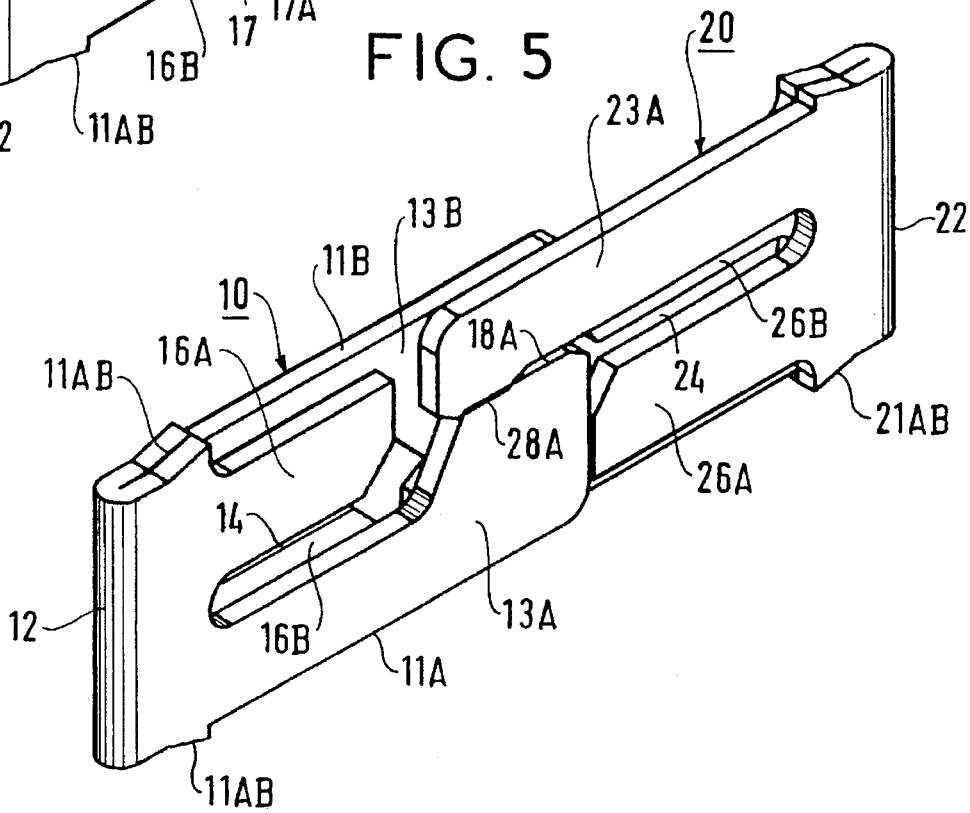

FIGS. 2 and 3 illustrate a preferred embodiment of a first contact 10 and a second contact 20, which are most advantageously used to form a connection in accordance with the invention, as illustrated in FIGS. 4 and 5.

Both of these contacts 10 and 20 are of the same type as the contact 1 already described. They are therefore not described in detail. The different portions of contact 10 are simply designated by the reference numerals 11 to 18 and those of contact 20 by the reference numerals 21 to 28, assigning the same units digits as in FIG. 1 to the corresponding portions of contacts 1, 10 and 20. The letters A and B accompanying these reference numerals likewise indicate the relationship of the portions in question to one or other of the two blades of these contacts.

The particular features of the contacts 10 and 20 are described hereinafter.

The width of the terminal portion of each resilient arm 13A and 13B of the contact 10 is slightly greater than half the width of the contact. They overlap one another at the front end portion of the contact. The inside edges 18A and 18B of these arms are rectilinear and each edge terminates in a chamfered end, not numbered.

In contrast, the width of the terminal portion of each resilient arm 23A and 23B of contact 20 is substantially less than half the width of the contact. Their inside edges 28*a* and 28B are set back from the axis of the contact to leave a gap between them into which the access opening 27 opens out and emerges at the front end opposite from end edge 22.

The width of this gap is substantially equal to or slightly less than the width of the overlapping parts of the resilient arms of the contact 10.

The connection defined by the two contacts 10 and 20 ensures better coupling of the resilient arms of the contacts. It provides compensation for a smaller pressure between the inside edges of two of the resilient arms situated in the same plane, such as arms 13A and 23A, by providing an increased pressure between the inside edges of the two other resilient arms 13B and 23B. It may be noted that the resilient arms of a single one of these two contacts 10 and 20, such as 10 in this case, abut the ends of the two truncated branches 26A and 26B of the other contact 20, whereas clearance is left between the resilient arms 23A and 23B of that other contact and the truncated branches 16A and 16B of the first contact 10.

Figure 6:
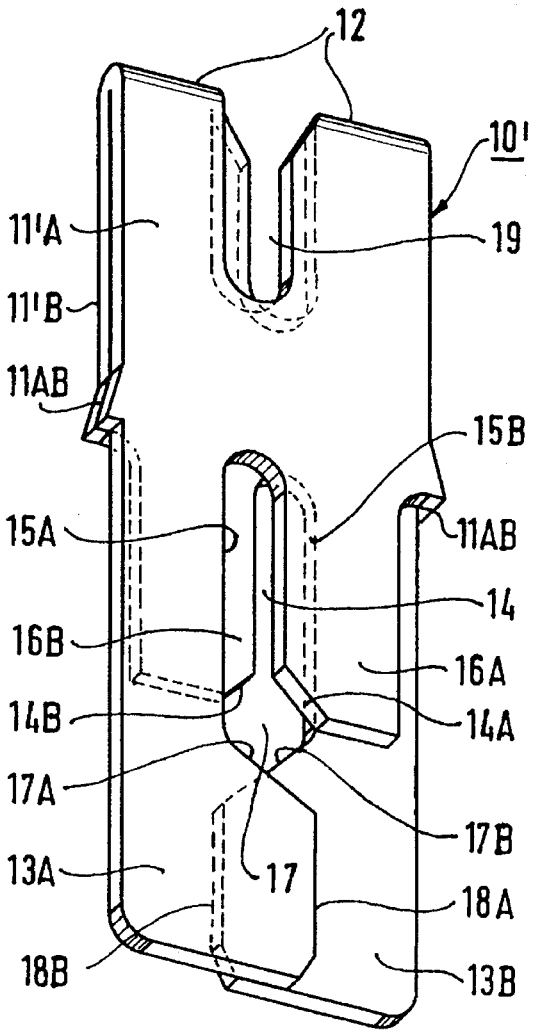
Figure 7:
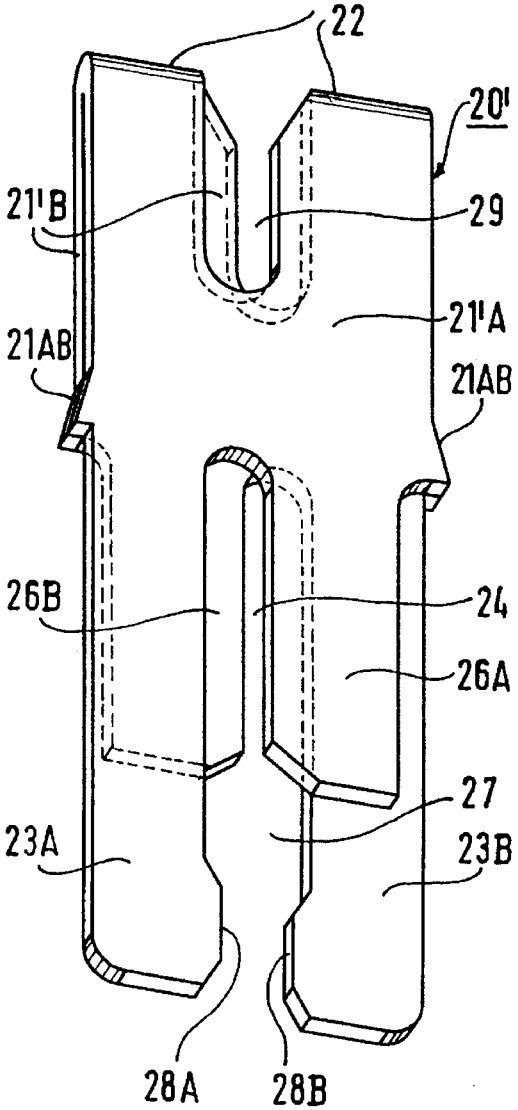

FIGS. 6 and 7 show two contacts 10' and 20', which are adaptations of the contacts 10 and 20 to allow a branch connection off each of them. Reference numerals on these adapted contacts identical to those of FIGS. 2 and 3 designate identical parts which are not be described any further.

It is simply indicated that contacts 10' and 20' are longer than contacts 10 and 20 and are formed from two blades 11'A and 11'B or 21'A and 21'B which are correspondingly longer.

These contacts 10' and 20' also comprise a second insulation displacement fork 19 or 29 according to the contact, to provide a branch connection if desired, the insulation displacement fork 14 or 24 being called the "main" fork. This second insulation displacement fork is open at the edge 12 or 22 of the contact. The second fork is aligned with the main fork. An insulated conductor connected to the second insulation displacement fork is therefore branched off the conductor which is connected to the main fork.

With regard to the embodiments illustrated and described above, the contacts may be formed from a single blade and may therefore comprise a single resilient terminal arm, a main insulation displacement fork open on the side where that arm is situated and an optional branch connection fork open on the edge opposite to the arm. However, embodiments with two blades held against each other are more advantageous in that they allow the main insulation displacement fork to be independent of the resilient arms by which the two contacts are coupled together. One of the edges 18A and 18B or 28A and 28B may be provided with a boss and the other with an indentation.

I claim:

1. A hermaphrodite contact, flat and substantially rectangular in shape, comprising a first end portion and a corresponding first end edge, a second end portion and a corresponding second end edge of said contact opposite said first end portion and said first end edge, an intermediate portion between said first and second end portions, at least one resilient arm which extends along said intermediate and second end portions and defines a hermaphrodite coupling terminal arm along said second end portion of the contact for hermaphrodite coupling of said contact to another substantially identical contact provided with at least one corresponding resilient arm, at least one truncated branch which extends from the first end portion towards the second end portion and along each resilient arm and is shorter than this resilient arm, and a main insulating displacement fork which extends substantially along the intermediate portion of the contact and between each resilient arm and the truncated branch and has an opening access facing the second end portion of said contact.

2. A contact according to claim 1, comprising:

two superposed and substantially identical blades, each having a first end along the first end edge of the contact, said blades being united with each other along their respective first ends and together defining said first and second end portions and said intermediate portion of the contact, along a longitudinal axis of the contact; and two resilient arms, one on each of the blades, and two truncated branches, one on each of the blades, each resilient arm having a width less than a width of one of the blades and each facing the truncated branch on the other blade, said resilient arms extending on respective sides of the longitudinal axis of the contact, wherein said blades each have a substantially U-shaped slit defined by a space between the resilient arm and the truncated branch, the slits together defining said main insulating displacement fork and the opening access to said main insulating displacement fork.

3. A connection defined by coupling together first and second contacts according to claim 2, wherein the resilient arms of said first contact partly overlap each other on both sides of said longitudinal axis of the first contact, and wherein the resilient arms of the second contact are set back from the longitudinal axis of the second contact, to leave between them a gap corresponding substantially ind width to the width of the overlapping portions of the resilient arms of the first contact.

4. A connection according to claim 2, wherein said slits are each wider than the main insulating displacement fork and longitudinally partly superposed over each other, said slits each extending on both sides of the longitudinal axis of the contact and each defining a first lateral branch coupled to the resilient terminal arm of the same blade and a second lateral branch substantially aligned with the truncated branch.

5. A contact according to claim 1, also comprising a branch insulation displacement fork, which opens to said first end portion of the contact.

6. A contact according to claim 5, wherein said main and branch forks are substantially aligned and extend axially along the contact.

7. A connection according to claim 4, wherein the truncated branches of only one of said first and second contacts abut the resilient arms of the other of said contacts, when these contacts are coupled to each other, and a gap is left between the truncated branches of the other of said contacts and the resilient arms of said only one of said first and second contacts.

* * * * *